US007098875B2

(12) United States Patent
Onozawa et al.

(10) Patent No.: US 7,098,875 B2
(45) Date of Patent: Aug. 29, 2006

(54) DISPLAY DEVICE

(75) Inventors: Makoto Onozawa, Kawasaki (JP); Yasuji Noguchi, Kawasaki (JP); Ayahito Kojima, Kawasaki (JP); Hideaki Ohki, Yokohama (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 393 days.

(21) Appl. No.: 10/376,479

(22) Filed: Mar. 3, 2003

(65) Prior Publication Data

US 2004/0008216 A1 Jan. 15, 2004

(30) Foreign Application Priority Data

Jul. 12, 2002 (JP) ..... 2002-204688

(51) Int. Cl.
*G09G 3/28* (2006.01)

(52) U.S. Cl. ..... 345/60; 345/63; 315/169.3

(58) Field of Classification Search ..... 345/60–67; 315/169.4, 169.3, 169.1
See application file for complete search history.

(56) References Cited

U.S. PATENT DOCUMENTS 6,720,940 B1 * 4/2004 Awamoto et al. ..... 345/60
6,812,932 B1 * 11/2004 Kasahara et al. ..... 345/613
2001/0026253 A1 * 10/2001 Eo ..... 345/60
2002/0154073 A1 * 10/2002 Kojima et al. ..... 345/60
2002/0167469 A1 11/2002 Todoroki et al.

FOREIGN PATENT DOCUMENTS

| | | |
|---|---|---|
| EP | 1 191 511 A2 | 3/2002 |
| JP | 10-207423 | 8/1998 |
| JP | 2000-10522 | 1/2000 |
| JP | 2002-99242 | 4/2002 |

* cited by examiner

*Primary Examiner*—Richard Hjerpe
*Assistant Examiner*—Kimnhung Nguyen
(74) *Attorney, Agent, or Firm*—Staas & Halsey LLP

(57) ABSTRACT

A display device that can prevent the thermal destruction and screen burn-in caused by display patterns has been disclosed. In this device, the display luminance is determined by the number of light emissions, and there are provided a sustain frequency control section that controls the sustain frequency, a load ratio calculation section that calculates the load ratio for each frame of display data, plural counters, a load ratio counter control section that controls so as to increase the counts of the counters corresponding to the load ratio level calculated by the load ratio calculation section, and a first judgment section that outputs a first control signal when any of the counts exceeds a first reference value, wherein the sustain frequency control section decreases the sustain frequency according to the first control signal.

10 Claims, 9 Drawing Sheets

DISPLAY DEVICE

BACKGROUND OF THE INVENTION

The present invention relates to a display device such as a plasma display (PD) device. More particularly, the present invention relates to a display device in which the display luminance is determined by the number of light emissions and the total number of light emissions in each cell of a display frame can be altered.

Recently, a display device has been required to be thinner with a larger screen size and to have a finer resolution, plus being capable of coping with the diversification of information to be displayed and conditions under which the product is installed. Types of a thin display devices include types such as LCD, fluorescent display tube, EL and PDP (plasma display panel). In a fluorescent display tube, EL or PDP, a gradation display is generally obtained by composing a display frame of plural subframes, weighting each subframe period in order to be different from each other, and expressing each bit of the gradation data by the corresponding subframe. A description is given below with a PDP as an example. As the PDP device is widely known, a detailed description of a PDP device itself is not given here but only a general description of a general PDP device is given.

FIG. 1 is a block diagram that shows the general configuration of a general PDP device. On a panel 10, plural X electrodes and Y electrodes are arranged adjacently by turns and plural address electrodes are arranged in the direction perpendicular to them. The plural X electrodes are connected commonly and an identical drive signal is applied thereto by an X side common driver 11. The plural Y electrodes are connected to a Y side scan driver 12 individually, and a scan pulse is applied sequentially during an address period. To the Y side scan driver 12, a Y side common driver 13 is connected and an identical drive signal is applied to the Y electrode during a reset period and sustain discharge period. The address electrode is connected to an address driver 14, an address pulse is applied during the address period in synchronization with the scan pulse, and the display cell in the line selected by the scan pulse is selected to be lit or not. A control section 15 internally comprises a display data control section 16, a scan driver control section 17 and a display/power control section 18, and a vertical synchronization signal Vsync, a dot clock and display data are supplied from the outside. The control section 15 comprises a CPU and each part mentioned above can be realized by hardware and by software run by the CPU. To the address driver 14, address pulse data is supplied from the display data control section 16. The X side common driver 11, the Y side scan driver 12 and the Y side common driver 13 are controlled by a scan driver control section 17.

As the method for driving a PDP device, the gradated display by the subframe method and power control have been disclosed, as in Japanese Unexamined Patent Publication (Kokai) No. 2002-99242, no basic description is given here.

As only two-value states are allowed, that is, a state of being lit and a state of being unlit, gradation is expressed by varying the numbers of light emissions in a PDP device. Therefore, the subframe method is employed, in which a frame is divided into plural subframes and the subframes to be lit are combined for display. The number of light emissions (the number of sustain pulses) in each subframe is adequately determined in advance and the maximum number of light emissions in each display cell is the total number of light emissions of all the subframes. As the maximum number of light emissions in each display cell is generally called the sustain frequency, the term is also used here.

When a bright picture is displayed, the total number of light emission pulses in a display frame is increased and the power consumption, that is, the consumed current is increased. The number of light emission pulses in a display frame over the entire screen becomes a maximum when all the cells are lit at the sustain frequency. The display load ratio is used as an index that shows the level of brightness of the entire picture. The display load ratio is a ratio of the total number of light emission pulses in all the cells in a display frame to the maximum number of light emission pulses. The display load ratio is 0% when all the cells are displayed in black, and 100%, when all the cells are displayed at the maximum luminance.

As the current that flows during the sustain period stand predominant as regards the consumed current, if the number of light emission pulses in a display frame is increased, the consumed current is also increased. If the number of sustain pulses in each subframe is assumed to be constant, that is, the sustain frequency is constant, the power consumption P (or consumed current) increases as the display load ratio increases.

A limit is set to the power consumption in the PDP device. It is possible to set the sustain frequency so that the power consumption is below the limit even when the display load ratio is maximum, that is, all the cells are displayed at the maximum luminance. However, the display load ratio of a normal picture is in the range from about 10% to about 30%, so it is highly unlikely that the display load ratio approaches 100% and, as a result, a problem occurs that a normal display becomes dark. Therefore, the power control is taken so that a display as bright as possible is obtained in the range in which the power consumption P is below the limit, by varying the sustain frequency according to the display load ratio. This power control is taken by the display/power control section 18 shown in FIG. 1. Conventional power controls have been disclosed in, for example, the above-mentioned Japanese Unexamined Patent Publication (Kokai) No. 2002-99242.

In the plasma display (PDP) device, heat is produced by light emission and discharge in each cell and the amount of produced heat is in proportion to the number of light emissions in a unit of time. Due to this, a large amount of heat is produced locally depending on the display pattern, the distribution of temperature appears on the panel surface, and thermal destruction may be caused at portions where the temperature gradient is large.

In order to solve these problems, the above-mentioned Japanese Unexamined Patent Publication (Kokai) No. 2002-99242 has disclosed a technology that can reduce the sustain frequency when a state in which the sustain frequency is large continues and there is the possibility that a thermal destruction will occur, the technology being developed by focusing on the fact that such a problem occurs only when the sustain frequency is large in the case where the sustain frequency is controlled according to the display load ratio.

One of the patterns that cause thermal destruction is, for example, a still picture with high contrast. If such a pattern is displayed for a long time, the phosphors and the like at the pattern are deteriorated and a phenomenon called the burn-in occurs, even if the thermal destruction is not caused. The technology disclosed in Japanese Unexamined Patent Publication (Kokai) No. 2002-99242 is simple, but a problem occurs that the brightness is lowered due to the reduction in the sustain frequency even when there is no problem of thermal destruction or burn-in in the case of video.

Japanese Unexamined Patent Publishing (Kokai) No. 10-207423 and Japanese Unexamined Patent Publishing (Kokai) No. 2000-10522 have disclosed a configuration in which control is done so that the luminance is lowered when a display pattern that will cause thermal destruction or burn-in is detected by comparing the display data in successive frames.

SUMMARY OF THE INVENTION

The present invention provides another method for judging whether the possibility of occurrence of thermal destruction and burn-in is high, and its object is to realize a new display device that can prevent thermal destruction and burn-in.

Similar to the configuration described above, the present invention judges the possibility of occurrence of thermal destruction and burn-in by focusing on the load ratio in successive frames and monitoring the load ratio, in order to judge whether the display pattern causes thermal destruction and burn-in.

As described above, the PDP device controls power based on the load ratio and, therefore, the calculation section for the load ratio has already been provided and if the display pattern is judged whether to cause a thermal destruction or burn-in by using the load ratio, judgment is easy to perform because a troublesome calculation is not necessary.

In concrete terms, there are provided plural counters, a load ratio counter control section that classifies the load ratios calculated by the existing load ratio calculation section into plural levels corresponding to the number of counters according to their values and controls the counters so as to increase the counts of the counters relating to the calculated level and decrease the counts of the other counters, and a first judgment section that judges the counts of plural counters and outputs a first control signal when any of the counts exceeds a first reference value, and a sustain frequency control section reduces the sustain frequency according to the first control signal.

As changes in the subdivided load ratio can be detected in this configuration, it is possible to judge the possibility of the occurrence of thermal destruction and burn-in of a panel with precision and, as a result, the luminance of a picture that does not cause thermal destruction and burn-in of a panel can be further improved.

On the contrary, when the load ratio varies, it is desirable to increase the sustain frequency because there is only a faint possibility that thermal destruction and burn-in of a panel will occur.

Moreover, there is a strong possibility that thermal destruction and burn-in of a panel will occur when the display data contains high gradation levels, and otherwise the possibility is faint. Therefore, the gradation level is calculated from the display data for each display frame, and the counts of the above-mentioned counters are increased when the display data contains a gradation level above a predetermined level and when not, the counts of all the counters are decreased.

It is possible to set the number of counters adequately. It is also possible to increase not only the count of the counter corresponding to the calculated load ratio level but also the counts of the neighboring counters, and to decrease the counts of the other counters. For example, it is possible to increase the counts of the counters on both sides.

Moreover, it is possible to set the increment and decrement of the count adequately, that is, the increment of the count can be greater than the decrement and, for example, to double the decrement.

Although the processes of calculation, judgment and control can be performed using circuits, it is desirable to perform them using programs run on the calculation device.

BRIEF DESCRIPTION OF THE DRAWINGS

The features and advantages of the invention will be more clearly understood from the following description taken in conjunction with the accompanying drawings in which.

DESCRIPTION OF THE PREFERRED EMBODIMENTS

Figure 1:
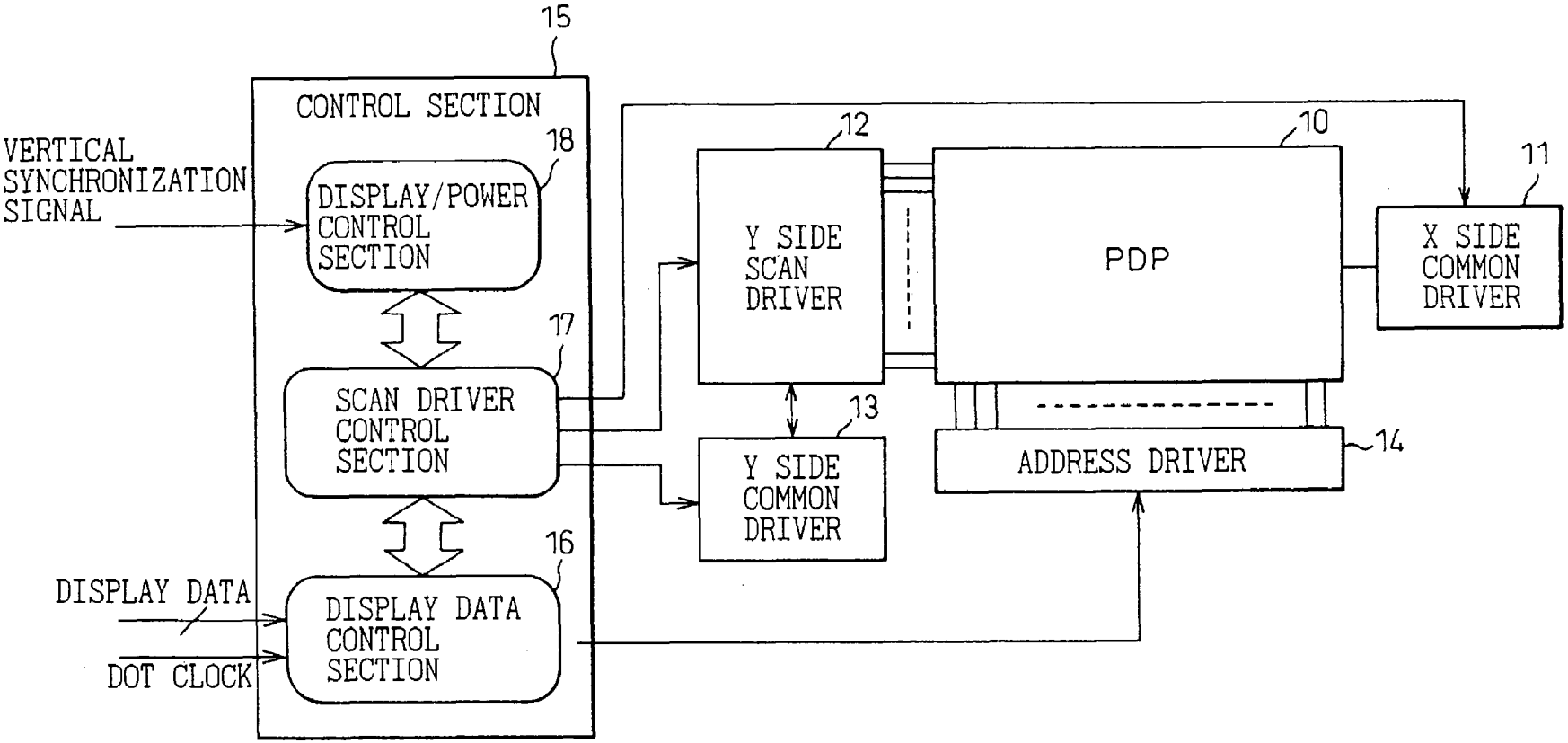
FIG. 1 is a block diagram that shows the general configuration of a general plasma display (PDP) device.

Embodiments in which the present invention is applied to the plasma display device (PDP) shown in FIG. 1 are described below. However, the present invention is not limited to these embodiments but can be applied to any display device as long as the display luminance is determined by the number of light emissions and the total number of light emissions in each cell in a display frame in a screen is altered according to power consumption or the like.

Figure 2:
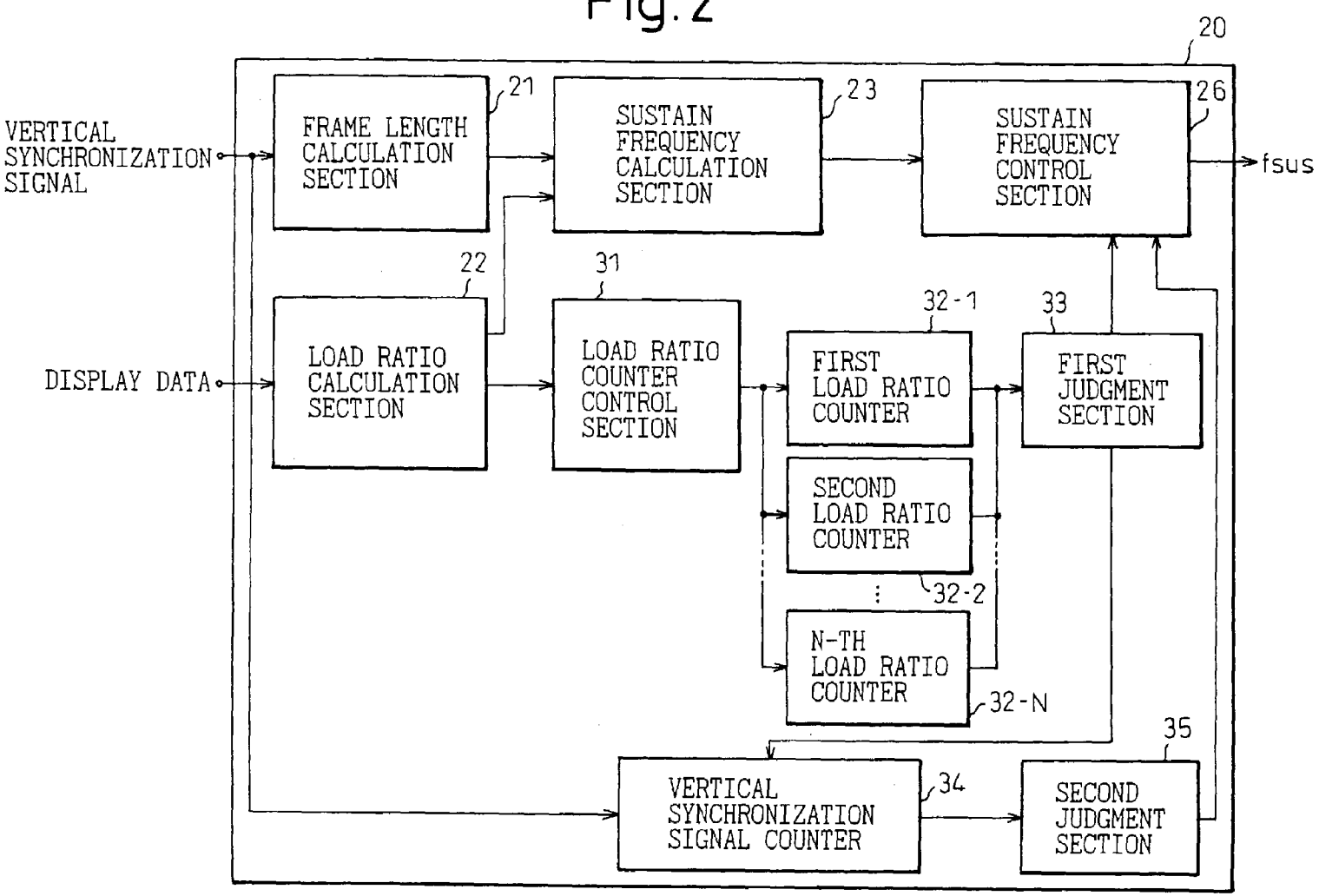
FIG. 2 is a diagram that shows the configuration of a power control section in a PDP device in a first embodiment of the present invention.

FIG. 2 is a diagram that shows the configuration of the power control section in the PDP device in the first embodiment of the present invention. The PDP device in the first embodiment has the configuration shown in FIG. 1, and the display/power control section 18 in the control section 15 has a power control section 20 has the configuration shown in FIG. 2. Other parts are the same as conventional ones described above.

As shown in FIG. 2, the power control section 20 comprises a frame length calculation section 21 that calculates the time period of a frame (frame length) from a vertical synchronization signal Vsync to be input, a load ratio calculation section 22 that calculates the load ratio of display data to be input, a sustain frequency calculation section 23 that calculates a sustain frequency fsus from the output results of the frame length calculation section 21 and the load ratio calculation section 22, and a sustain frequency control section 26 that determines a sustain frequency. The above-mentioned configuration has been disclosed in Japanese Unexamined Patent Publication (Kokai) No. 2002-99242.

The power control section 20 in the present invention further comprises a load ratio counter control section 31, a first load ratio counter 32-1 to an N-th load ratio counter 32-N, a first judgment section 33, a vertical synchronization signal counter 34 and a second judgment section 35.

The load ratio counter control section 31 classifies the load ratio of each frame output from the load ratio calculation section 22 into N levels according to its value and provides control to increase the counts of the counters relating to the value among the N counters and decrease the counts of the other counters. For example, when the load ratio is M, the count of the M-th load ratio counter 32-M is increased and the counts of the other load ratio counters are decreased. Moreover, it is possible to specify the number of counters, the counts of which are to be increased, depending on the number of load ratio counters in such a way as to increase not only the count of the M-th load ratio counter 32-M but also the counts of the (M−1) th load ratio counter and the (M+1) th load counter, and to decrease the counts of the other load ratio counters. It is also possible to specify the increment and decrement adequately and in such a way as to increase the count by two and decrease the count by one.

The first judgment section 33 judges the counts of the N load ratio counters, and outputs a first control signal to the sustain frequency control section 26 and the vertical synchronization signal counter 34 when any of the counts exceeds a first reference value.

The vertical synchronization signal counter 34 counts the input vertical synchronization signals and outputs the count to the second judgment section 35. As the vertical synchronization signal is input at the beginning of a frame, the vertical synchronization signal counter 34 counts the number of frames as a result. The vertical synchronization signal counter 34 resets the count on receiving the first control signal from the first judgment section 33.

The second judgment section 35 judges whether the count of the vertical synchronization signal counter 34 exceeds a second fixed value, and if so, outputs a second control signal to the sustain frequency control section 26.

The sustain frequency control section 26 determines the sustain frequency fsus based on the output result of the sustain frequency calculation section 23, and it decreases the sustain frequency fsus when receiving the first control signal and increases the sustain frequency fsus when receiving the second control signal. The sustain frequency fsus is altered while power consumption is being taken into account, within limits.

Although the power control section 20 can be realized using hardware circuits, it can also be realized using software programs run by a central processing unit (CPU).

Figure 3:
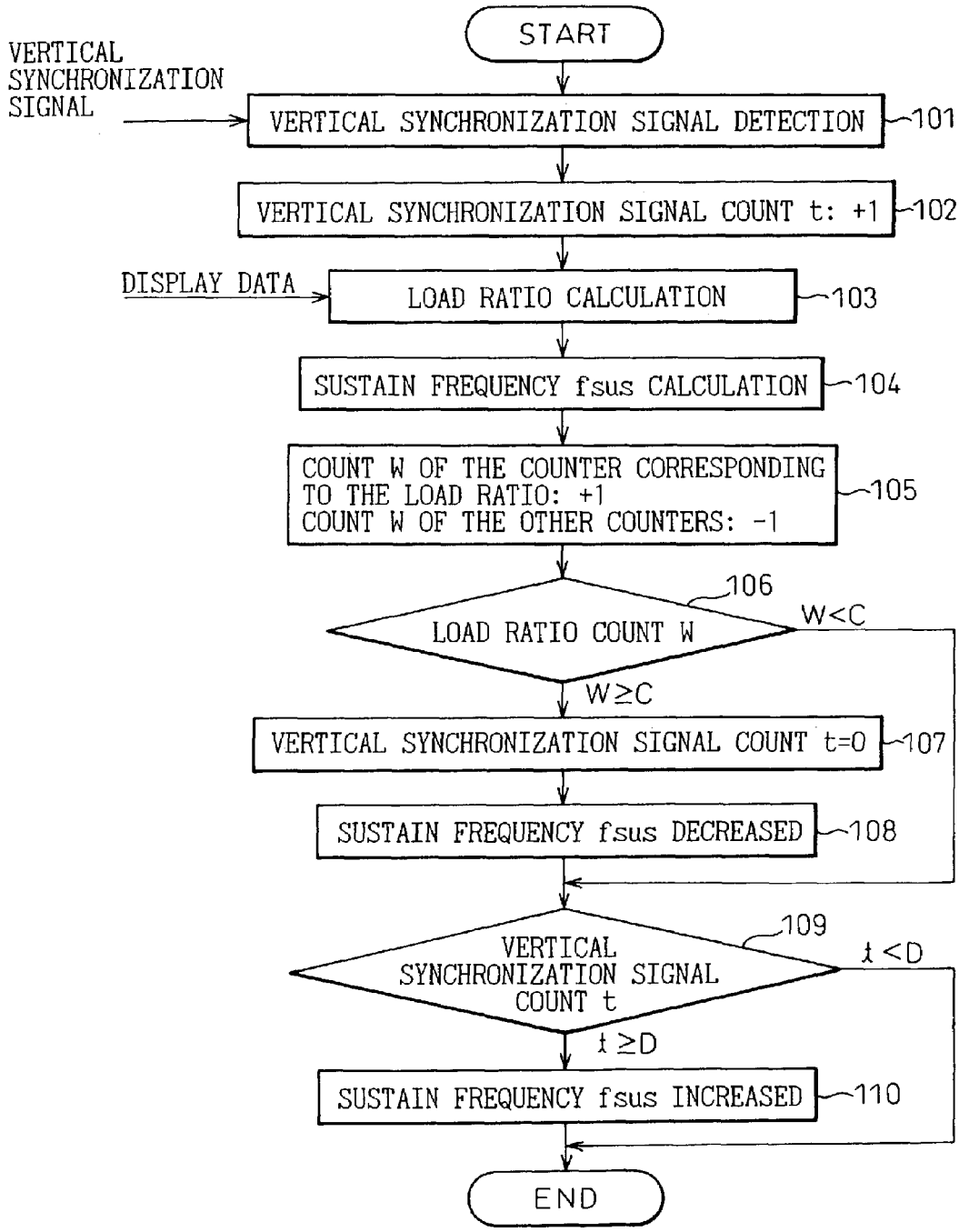
FIG. 3 is a flow chart that shows the process in the power control section in the first embodiment.

FIG. 3 is a flow chart that shows the process in the first embodiment.

In step 101, the vertical synchronization signal is detected, and the count of the vertical synchronization signal is increased by one in step 102. In step 103, the load ratio is calculated from the display data, and in step 4, the sustain frequency fsus is temporarily determined from the calculated load ratio.

In step 105, the counts W of the load ratio counters corresponding to the calculated load ratio are increased by one and the counts W of the other load ratio counters are decreased by one. In step 106, whether any of the counts W of the plural load ratio counters exceeds the first reference value C is judged. If the first reference value C is not exceeded, the next step will be step 109. If the first reference value C is exceeded, the count t of the vertical synchronization signal counter is reset to zero in step 107 and the sustain frequency fsus is decreased in step 108.

In step 109, whether the count t of the vertical synchronization signal counter exceeds the second reference value D is judged. If the second reference value D is not exceeded, the process is terminated, and if the second reference value D is exceeded, the sustain frequency fsus is increased in step 110.

As described above, the continuance of a certain load ratio in the plural load ratio counters is detected in the first embodiment. In the case of a still picture, as a certain load ratio continues, whether it is a still picture is judged. In an actual configuration, it is unlikely that a thermal destruction and burn-in occur when the load ratio is no less than 50% because the sustain frequency is reduced due to the power consumption control, therefore, the range from 0% to 50% is divided into 256 parts and 256 load ratio counters are provided. Even the display data of an almost still picture varies to a certain extent, therefore it is advisable, for example, to increase the counts by two of the two counters on both sides of the load ratio counter corresponding to the calculated load ratio and decrease the counts by one of the other load ratio counters. Then, it is necessary to reduce the sustain frequency when a still picture continues for a minute, that is, the count of the load ratio counter exceeds 7200, which is the product of 60 (frames per second)×60×2.

As the count of the vertical synchronization counter is reset by the first control signal, it represents the number of frames after a still picture has been displayed. The sustain frequency has been reduced because a still picture is displayed, but when the frames corresponding to the second reference value are displayed after the still picture is not displayed, the thermal distortion and the like are corrected, therefore, it is advisable to increase the sustain frequency.

Figure 4:
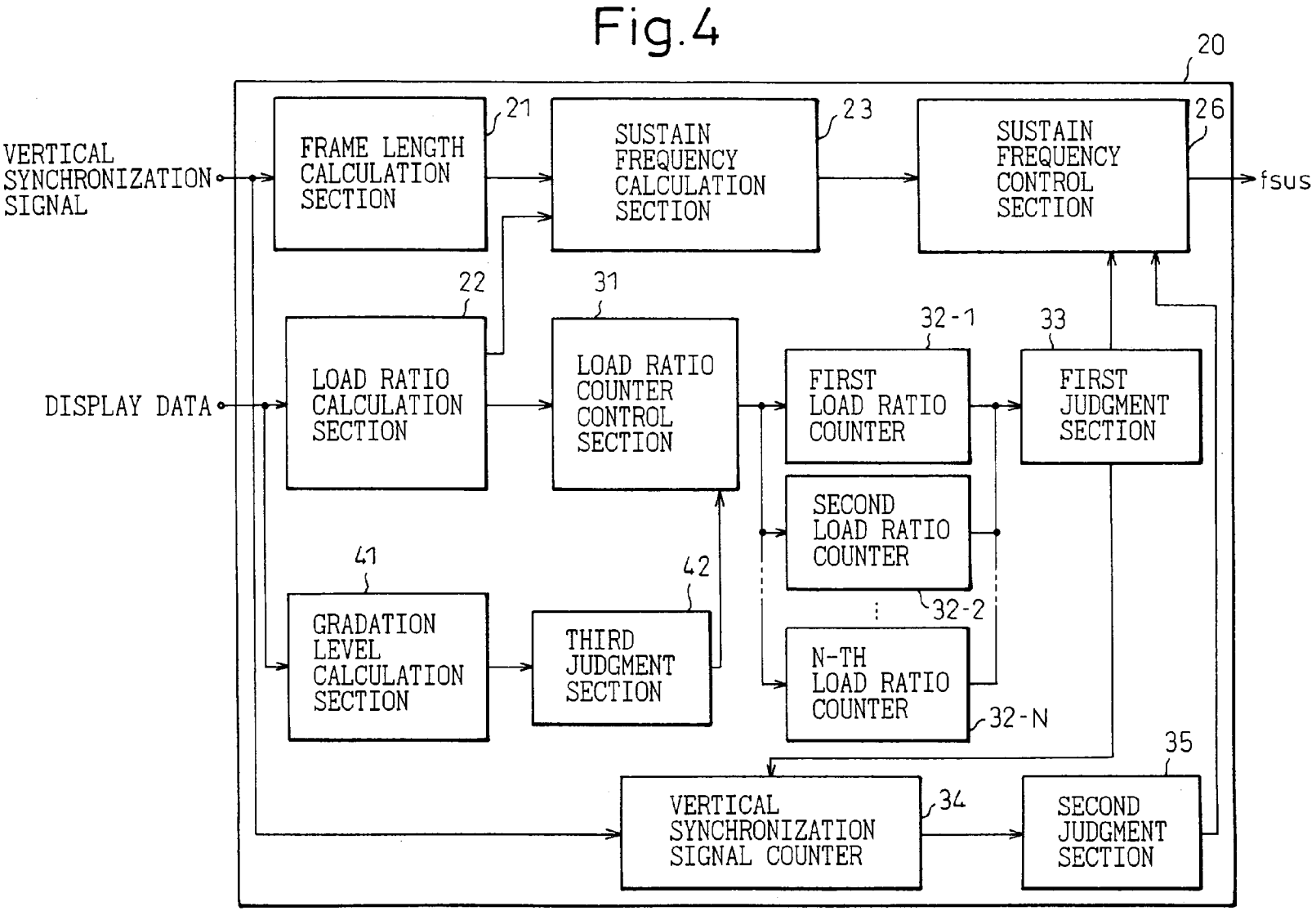
FIG. 4 is a diagram that shows the configuration of a power control section in a PDP device in a second embodiment of the present invention.

FIG. 4 is a diagram that shows the configuration of the power control section in the PDP device in the second embodiment of the present invention. As shown schematically, the power control section in the second embodiment differs from that in the first embodiment in that a gradation level calculation circuit 41 and a third judgment section 42 are added. The gradation level calculation circuit 41 calculates, based on the display data, to check which gradation level is included. The third judgment section 42 judges whether the calculated gradation level contains a gradation exceeding a predetermined level, and if so, it produces and outputs a third control signal to the load ratio counter control section 31. The load ratio counter control section 31 increases the counts of the load ratio counters relating to the calculated level and decreases the counts of the other load ratio counters for each display frame when the third control signal is produced, and decreases the counts of all the load ratio counters when the third control signal is not produced.

Figure 5:
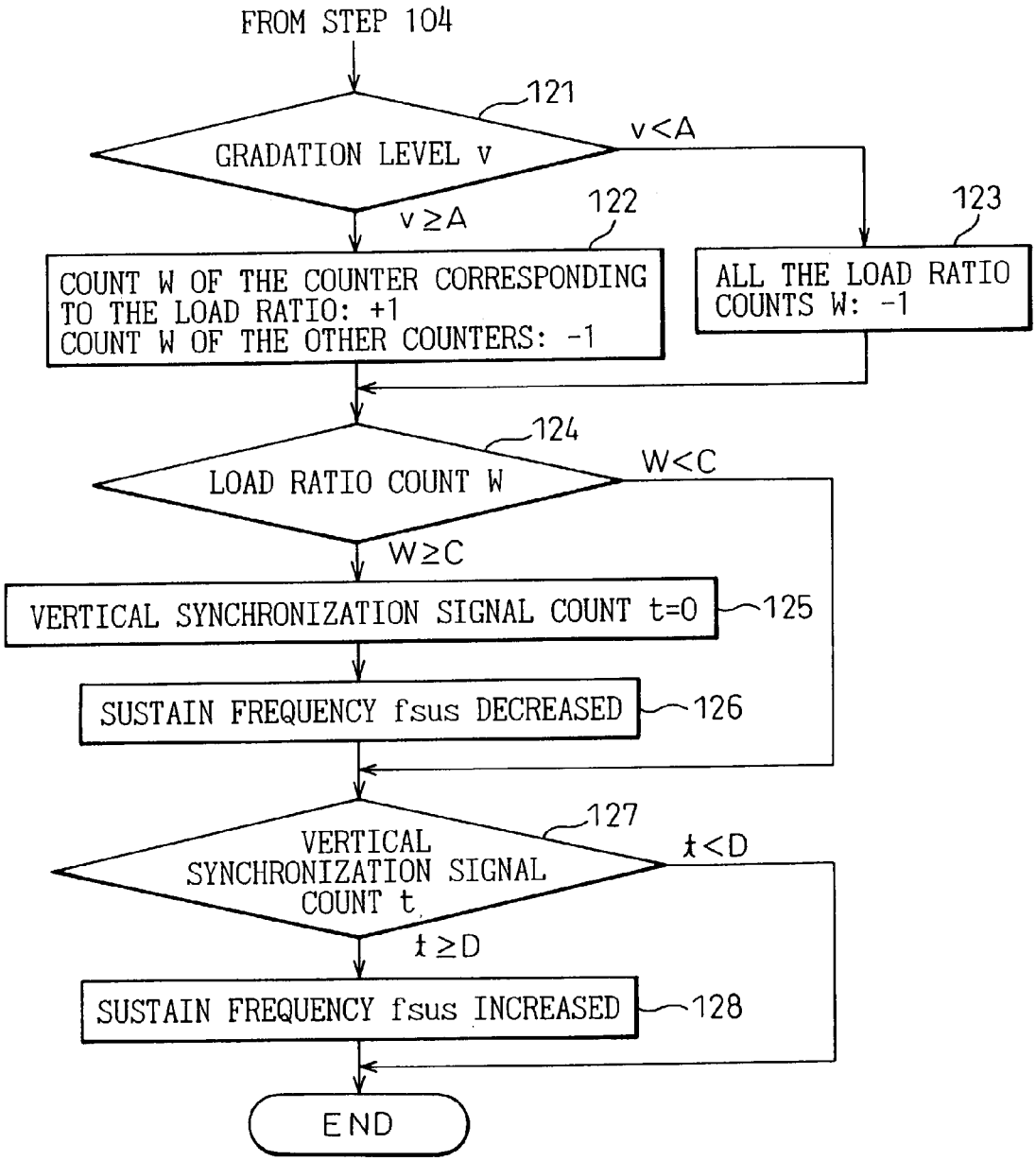
FIG. 5 is a flow chart that shows the process in the power control section in the second embodiment.

FIG. 5 is a flow chart that shows the process in the power control section in the second embodiment. The first several steps of the process in the second embodiment are the same as the steps to step 104 in the first embodiment, and steps 124 to 128 are the same as steps 106 to 110 in the first embodiment. The difference is that steps 121 to 123 are performed instead of step 105.

In step 121, the maximum value v of the gradation level values calculated from the display data is compared with a predetermined gradation level value A. If v is greater than A, the counts W of the related load ratio counters are increased by one and the counts W of the other load ratio counters are decreased by one in step 122, similar to step 105 in the first embodiment. If v is less than A, the counts W of all the load ratio counters are decreased by one in step 123.

In other words, when the maximum value v of the gradation level values is greater than the predetermined gradation value A in the second embodiment, the same process as the first embodiment is performed and when the maximum value is less than A, the counts W of all the load ratio counters are decreased. Similar to the first embodiment, there can be various modifications as to which count of the load ratio counter is increased and how the count of the load ratio counter is altered.

Thermal destruction and burn-in occur when a picture is still and dark on the whole, but to be exact, only when a picture has a part where the luminance is high, that is, the gradation level is high. This means that the thermal destruction and burn-in do not occur in a still picture if the maximum gradation level is low. In the second embodiment, a picture is prevented from becoming excessively dark in such a case by preventing the sustain frequency from being reduced.

Figure 6:
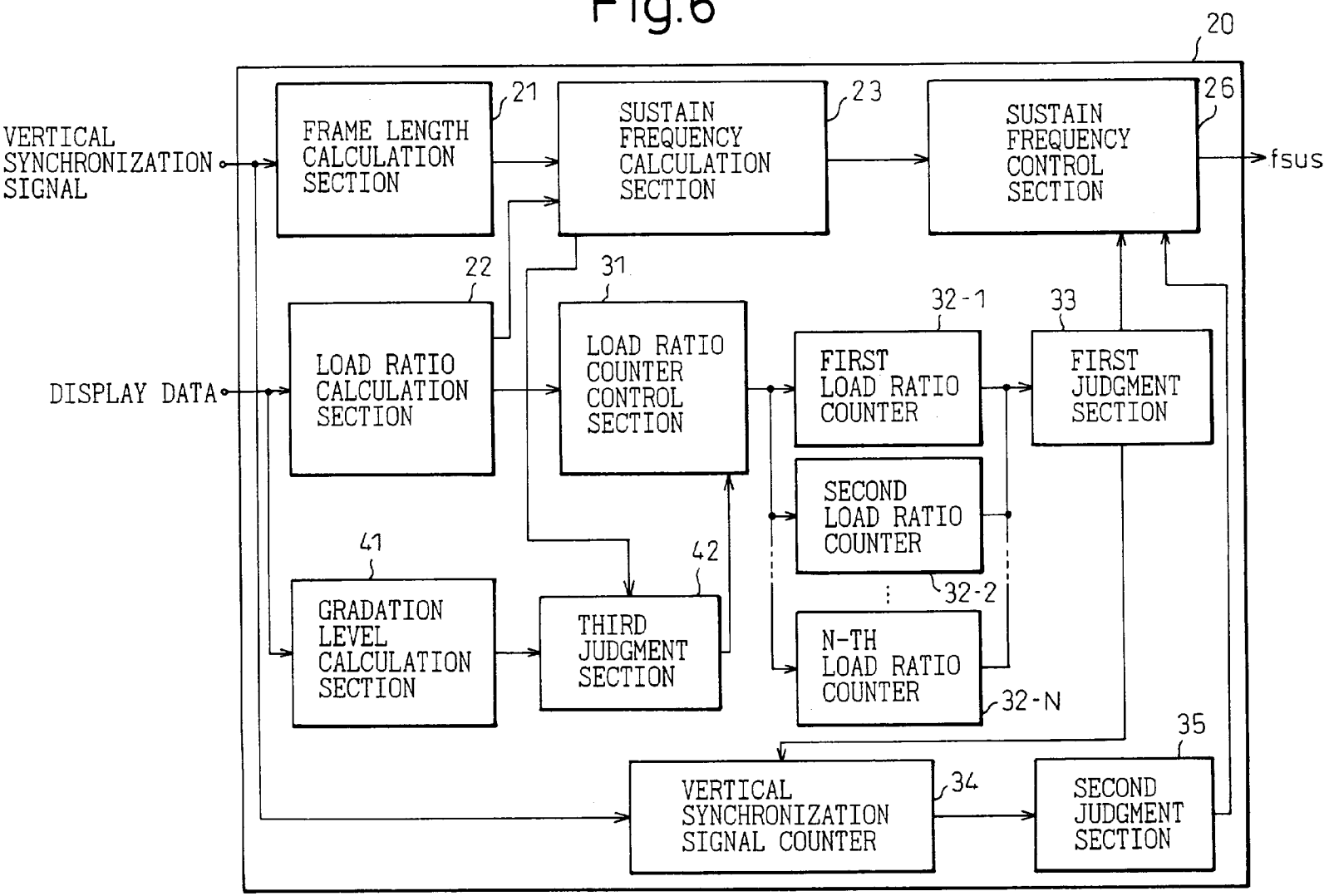
FIG. 6 is a diagram that shows the configuration of a power control section in a PDP device in a third embodiment of the present invention.

FIG. 6 is a diagram that shows the configuration of the power control section in the PDP device in the third embodiment of the present invention. As shown schematically, in the power control section in the third embodiment, whether the sustain frequency fsus calculated in the sustain frequency calculation section 23 is equal to or greater than a predetermined value B is judged, while the third judgment section 42 judges whether the calculated gradation level v contains a gradation A higher than a predetermined gradation level in the power control section in the second embodiment at the same time and, when both are satisfied, the third control signal is produced and output to the load ratio counter control section 31. As in the second embodiment, the load ratio counter control section 31 increases the counts of the load ratio counters relating to the calculated level and decreases the counts of the other load ratio counters for each display frame when the third control signal is produced, and decreases the counts of all the load ratio counters when the third control signal is not produced.

Figure 7:
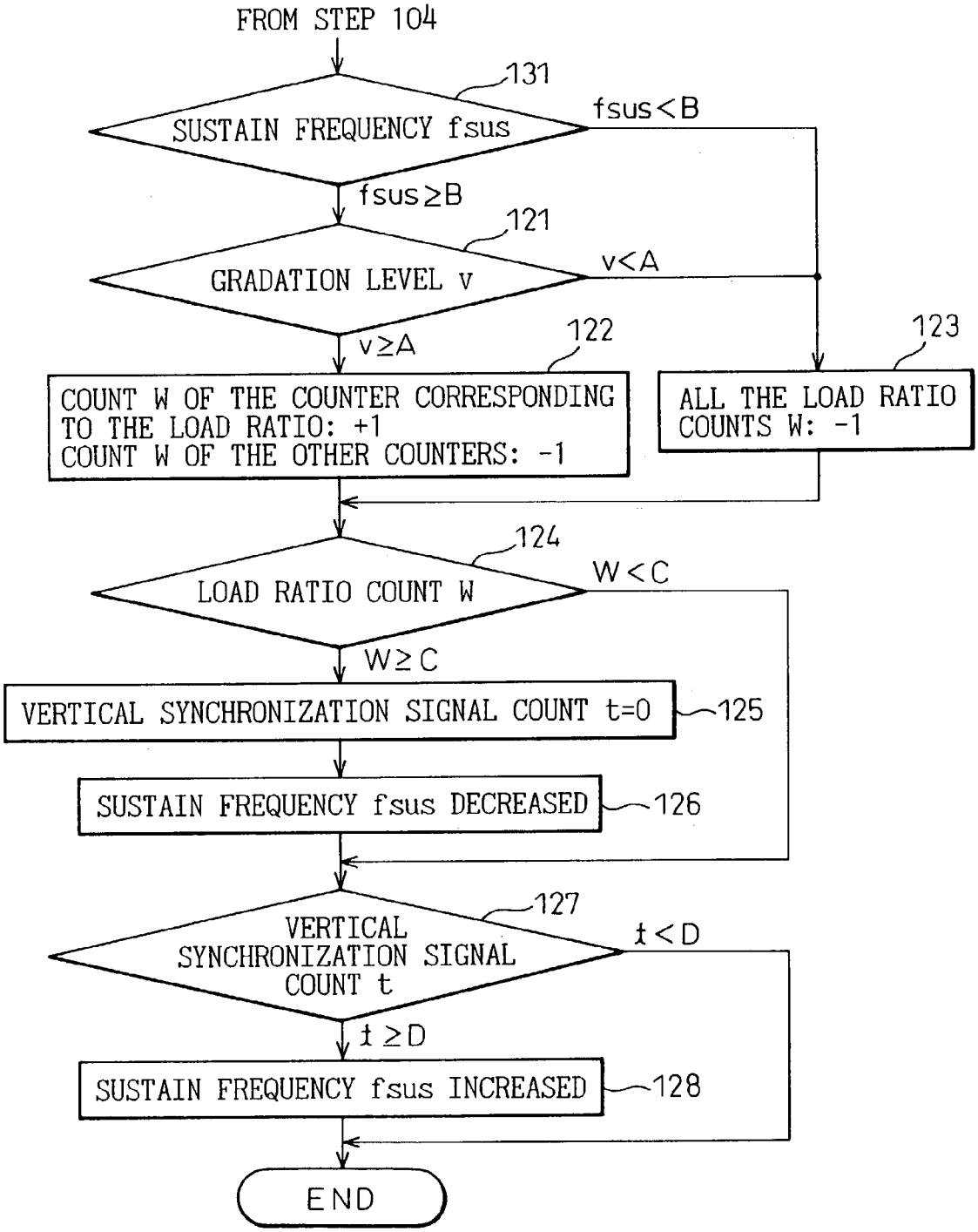
FIG. 7 is a flow chart that shows the process in the power control section in the third embodiment.

FIG. 7 is a flow chart that shows the process in the power control section in the third embodiment. The process in the third embodiment differs from the process in the second embodiment in that a step 131 is provided, before step 121, where whether the sustain frequency fsus is equal to or greater than the predetermined value B is judged, and when the sustain frequency fsus is equal to or greater than the predetermined value B, the next step is step 121, and when the sustain frequency fsus is less than the predetermined value B, the next step is step 123.

In other words, when the sustain frequency fsus is equal to or greater than the predetermined value B in the third embodiment, the same process as the second embodiment is performed and when the sustain frequency is less than B, the counts w of all the load ratio counters are decreased. As in the first and second embodiments, there can be various modifications as to which count of the load ratio counter is increased and how the count of the load ratio counter is altered.

Thermal destruction and burn-in occur when a picture is still and dark on the whole, having a part with high gradation level and a large sustain frequency. This means that the thermal destruction and burn-in do not occur even in a still picture that is bright on the whole, and having a part with high gradation level, because the sustain frequency is reduced due to the power consumption control. In the third embodiment, a picture is prevented from becoming excessively dark in such a case by preventing the sustain frequency from being reduced.

Figure 8:
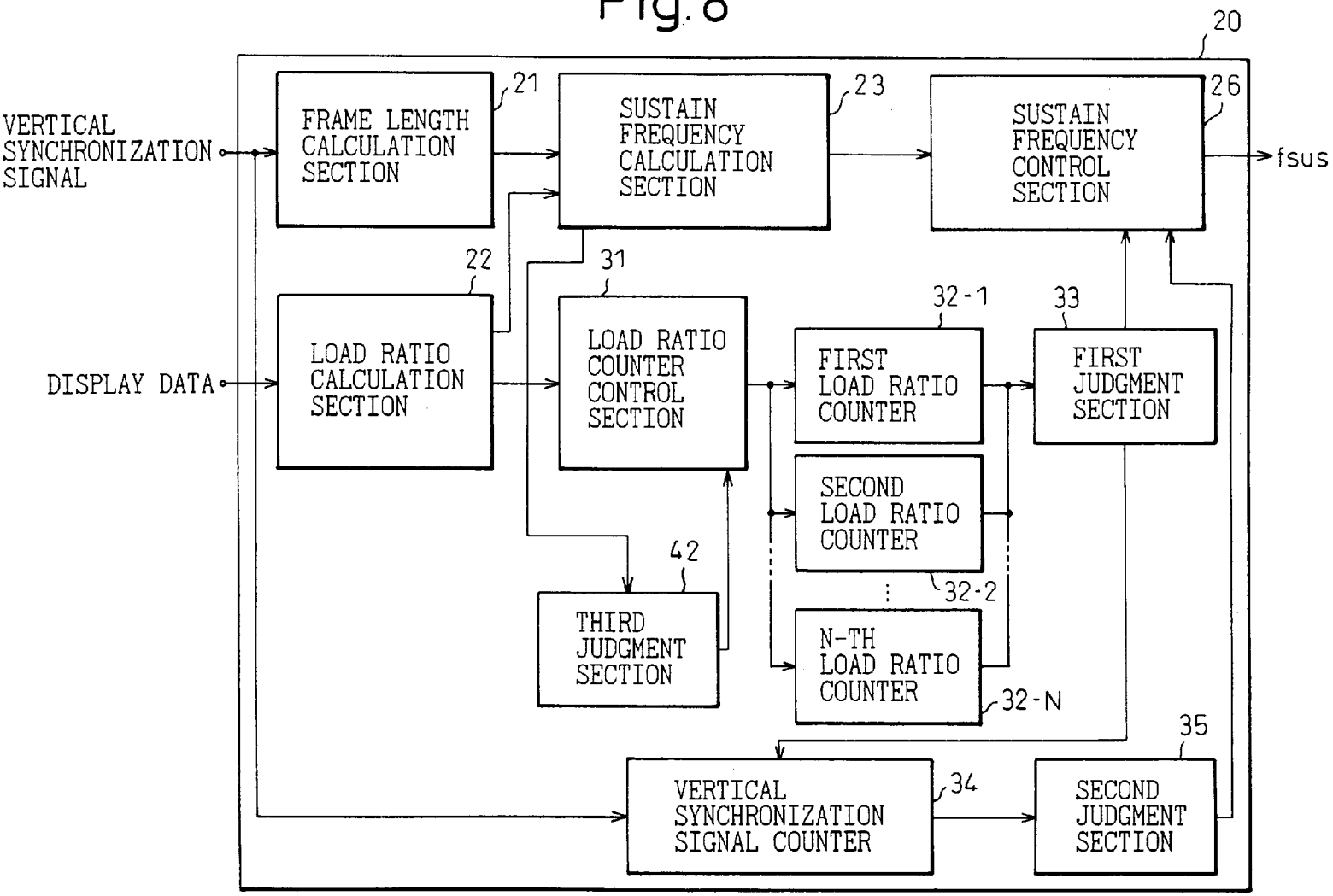
FIG. 8 is a diagram that shows the configuration of a power control section in a PDP device in a fourth embodiment of the present invention.

FIG. 8 is a diagram that shows the configuration of the power control section in the PDP device in the fourth embodiment of the present invention. As shown schematically, the power control section in the fourth embodiment differs from the power control section in the first embodiment in that the third judgment section 42 is added. The third judgment section 42 judges whether the sustain frequency fsus calculated by the sustain frequency calculation section 23 is equal to or greater than the predetermined value B and if the sustain frequency fsus is equal to or greater than the predetermined value B, it produces and outputs the third control signal to the load ratio counter control section 31. As in the first embodiment, the load ratio counter control section 31 increases the counts of the load ratio counters relating to the calculated level and decreases the counts of the other load ratio counters for each display frame when the third control signal is produced, and decreases the counts of all the load ratio counters when the third control signal is not produced.

Figure 9:
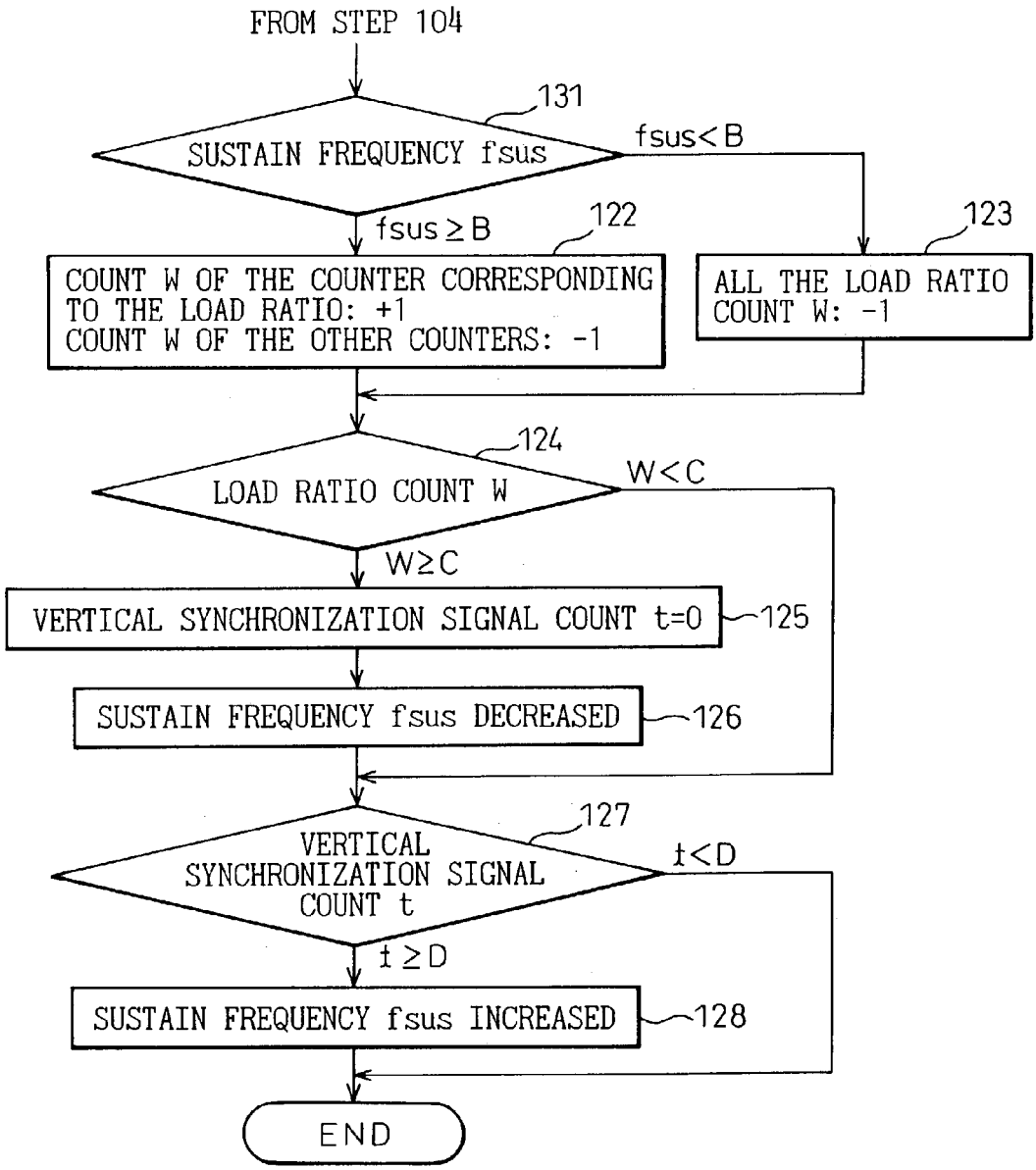
FIG. 9 is a flow chart that shows the process in the power control section in the fourth embodiment.

FIG. 9 is a flow chart that shows the process in the power control section in the fourth embodiment. The first several steps of the process in the fourth embodiment are the same as the steps to 104 in the first embodiment, and steps 124 to 128 are the same as steps 106 to 110 in the first embodiment. The difference is that steps 131, 122 and 123 are performed instead of step 105.

In step 131, whether the sustain frequency fsus is equal to or greater than the predetermined value B is judged. If the sustain frequency fsus is equal to or greater than the predetermined value B, the counts W of the related load ratio counters are increased by one and the counts W of the other load ratio counters are decreased by one in step 122, as is similar to step 105 in the first embodiment. If the sustain frequency fsus is less than the predetermined value B, the counts W of all the load ratio counters are decreased by one in step 123.

In other words, when the sustain frequency fsus is equal to or greater than the predetermined value B in the fourth embodiment, the same process as the first embodiment is performed and when the sustain frequency is less than B, the counts W of all the load ratio counters are decreased. As in the first embodiment, there can be various modifications as to which count of the load ratio counter is increased and how the count of the load ratio counter is altered.

Thermal destruction and burn-in occur when a picture is still and dark, on the whole and, has a large sustain frequency. This means that thermal destruction and burn-in do not occur even in a still picture that is bright on the whole, because the sustain frequency is reduced due to the power consumption control. In the fourth embodiment, a picture is prevented from becoming excessively dark in such a case by preventing the sustain frequency from being reduced.

As described above, according to the present invention, thermal destruction and screen burn-in of a panel caused by the display patterns can be prevented.

We claim:

1. A display device having plural cells in which light is selectively emitted and the display luminance is determined by the number of light emissions, comprising:

a sustain frequency control section that controls the sustain frequency in a display frame;

a load ratio calculation section that calculates the load ratio for each frame of display data;

three or more counters respectively counting numbers of frames respectively having load ratios of predetermined levels;

a load ratio counter control section that controls so as to increase the counts of counters corresponding to the load ratio level calculated by the load ratio calculation section among the three or more counters; and a first judgment section that judges the counts of the three or more counters and outputs a first control signal when any of the counts exceeds a first reference value, wherein the sustain frequency control section decreases the sustain frequency according to the first control signal.

2. A display device, as set forth in claim 1, further comprising:

a frame counter that counts the number of frames and is reset by the first control signal; and a second judgment section that outputs a second control signal when the count of the frame counter exceeds a second reference value, wherein the sustain frequency control section increases the sustain frequency according to the second control signal.

3. A display device, as set forth in claim 1, further comprising:

a gradation level calculation section that calculates a gradation level from the display data; and a third judgment that judges whether the calculated gradation level contains a gradation higher than a predetermined gradation level and outputs a third control signal when the calculated gradation level contains a gradation higher than the predetermined gradation level, wherein the load ratio counter control section increases the counts of the counters relating to the calculated load ratio level and decreases the counts of the other of the three or more counters when the third control signal is produced, and decreases the counts of all the three or more counters when the third control signal is not produced.

4. A display device, as set forth in claim 3, wherein the third judgment section further judges whether the sustain frequency is equal to or greater than a predetermined sustain frequency and outputs the third control signal only when the sustain frequency is equal to or greater than the predetermined sustain frequency.

5. A display device, as set forth in claim 1, further comprising a third judgment section that judges whether the sustain frequency is equal to or greater than a predetermined sustain frequency and outputs a third control signal when the sustain frequency is equal to or greater than the predetermined sustain frequency, wherein the load ratio counter control section increases the counts of the counters relating to the calculated level and decreases the counts of the other of the three or more counters when the third control signal is produced, and decreases the counts of all the three or more counters when the third control signal is not produced.

6. A display device, as set forth in claim 1, wherein the load ratio counter control section increases the counts of the counter corresponding to the calculated load ratio level, the counter the level of which is lower than the calculated level by one, and the counter the level of which is higher than the calculated level by one, and decreases the counts of the other of the three or more counters.

7. A display device, as set forth in claim 6, wherein the increment of the count is greater than the decrement of the count.

8. A display device, as set forth in claim 7, wherein the increment of the count is double the decrement of the count.

9. A display device, as set forth in claim 1, wherein the calculation process, judgment process and control process in the display device are performed with the software programs run by the calculation device.

10. A method for preventing thermal destruction and burn-in in a display, the method comprising:

increasing counts of counters, among three or more counters respectively counting numbers of frames respectively having load ratios of predetermined levels, corresponding to a calculated load ratio level;

judging the counts of the three or more counters and outputting a control signal when any of the counts exceeds a first reference value; and decreasing a sustain frequency according to the control signal.

* * * * *